US005092945A

United States Patent [19]

Reed, Jr. et al.

[11] Patent Number: 5,092,945

[45] Date of Patent: Mar. 3, 1992

[54] GLYCIDYL AZIDE PROPELLANT WITH ANTIGASSING ADDITIVES

[75] Inventors: Russell Reed, Jr.; May L. Chan, Ridgecrest, both of Calif.

[73] Assignee: The United States of America as represented by the Secretary of the Navy, Washington, D.C.

[21] Appl. No.: 353,295

[22] Filed: Mar. 1, 1982

[51] Int. Cl.[5] ..... C06B 45/10

[52] U.S. Cl. ..... 149/19.4; 149/19.6; 149/19.92; 149/36; 149/92

[58] Field of Search ..... 149/19.4, 36, 19.6, 149/92, 19.92

[56] References Cited

U.S. PATENT DOCUMENTS

| | | | |
|---|---|---|---|
| 3,137,599 | 6/1964 | Alsgaard et al. | 149/19.2 |
| 3,665,862 | 5/1972 | Lane | 149/19.2 |
| 3,734,789 | 5/1973 | Moy et al. | 149/19.9 |
| 3,767,488 | 10/1973 | Seals | 149/7 |
| 3,909,322 | 9/1975 | Chang et al. | 149/19.4 |
| 4,061,511 | 12/1977 | Baczuk | 149/19.1 |
| 4,116,734 | 9/1978 | Perrault et al. | 149/19.2 |
| 4,268,450 | 5/1981 | Frankel et al. | 149/19.6 |
| 4,269,637 | 5/1981 | Flanagan | 149/19.91 |
| 4,288,262 | 9/1981 | Flanagan et al. | 149/19.6 |
| 4,350,542 | 9/1982 | Kincaid | 149/92 |
| 4,379,903 | 4/1983 | Reed et al. | 528/55 |

*Primary Examiner*—Edward A. Miller

*Attorney, Agent, or Firm*—Melvin J. Sliwka; John L. Forrest, Jr.

[57] ABSTRACT

The invention describes a composition and a process for making void free solid propellants for rockets. This is accomplished by adding amino silanes and dimer diepoxide to GAP binder and deflagrating additive and then curing it.

12 Claims, No Drawings

GLYCIDYL AZIDE PROPELLANT WITH ANTIGASSING ADDITIVES

BACKGROUND OF THE INVENTION

This invention relates to the composition of propellants and more particularly to the field of solid propellants used in rockets. When used in a propellant formula glycidyl azide polymer (GAP) decomposes exothermically to give a high yield of permanent gases due to decomposition of the azido group which releases of 80Kcal/mol of CN bond. However, GAP and curatives have a tendency to evolve $CO_2$ with acidic deflagrating additives when they are used along with them to form combustible gas generant formulations. Also the isocyanate curatives generally used in GAP formulations react with acidic deflagrating additives such as acidic tetrazoles to produce $CO_2$, with the result that a porous propellant with erratic burning rates is produced. Formulations with GAP and high nitrogen solid additives provide exceptionally good rubbery propellants with high gas yield, tailorable burning rates and relatively cool flame temperature. It is therefore highly desirable to prevent gassing in formulations using acidic oxidizers. Therefore it is the object of this invention to provide void free propellants.

BRIEF SUMMARY OF THE INVENTION

The object of the present invention is achieved, in accordance therewith by providing a process of making void free propellants. According to the process glycidyl azide polymer, deflagrating additives, a silane amine and dimer acid diepoxide are mixed together to form a slurry. The slurry is stirred and heated in vacuum at 120°-140° F. The isocyanate curative is then added to the slurry to form a mixture which is cured.

DESCRIPTION OF THE PREFERRED EMBODIMENT

Coating agents capable of reacting with the acidic surface to form a polymeric coating were added to the mixtures of glycidyl azide polymer (GAP)

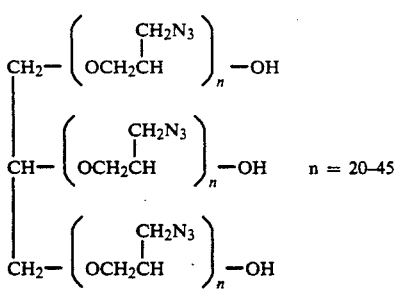

GAP and deflagrating additives. The slurry was stirred and placed in a vacuum at 120°-140° F. to remove reaction products such as $NH_3$ and to complete the coating of the acidic additives. The isocyanate curative was then added and the mixture was then cured at 120°-145° F. to yield propellants free of voids. The coating agents included basic derivative of 3-aminopropyltrialkoxysilanes such as $H_2NCH_2CH_2NHCH_2CH_2CH_2Si(OCH_3)_3$ (Dow Corning ZC 6020) and dimer acid diepoxide (XU-161 Ciba Geigy). The invention will be further illustrated by, but is not intended to be limited to, the following detailed examples. All parts by weight.

| Examples | 1 | 2 | 3 | 4 |
|---|---|---|---|---|
| GAP | 39.999 | 39.999 | 39.999 | 39.999 |
| Trimer of HMDI (hexamethylenediisocyanate) | 7.77 | 7.77 | 7.77 | 7.77 |
| Dimer acid diepoxide | 1.44 | 1.44 | 1.44 | 1.44 |
| ZC 6020 (amine silane) | 0.72 | 0.72 | 0.72 | 0.72 |
| GAT (Guanylaminotetrazole) | 49.98 | | | |
| ANT (Ammonium salt of 5-nitraminotetrazole) | | 49.98 | | |
| DHTT (dihydrazinium-3,6-bistetrazolyl-1,2-dihydrotetrazine) | | | 49.98 | |
| GBT (Guanidine bitetrazole) | | | | 49.98 |
| Triphenyl Bismuth | .02 | .02 | .02 | .02 |
| Dibutyltin laurate (T-12) | .001 | .001 | .001 | .001 |
| Carbon Black (opacifier) | .07 | .07 | .07 | .07 |

a. Mix all the ingredients except trimer of HMDI. Evacuate for 30 minutes at 120° F. to remove air.
b. Add trimer of HMDI and mix.
c. Cast cure at 120° F. overnight.

Addition of amine silanes and dimer acid diepoxide eliminates gassing, presumably by reacting with the acidic hydrogens and thereby neutralizing them or reacting with traces of moisture to form a siloxane polymer coating on the surface of the tetrazoles. A mixture of the silane and the epoxide is more effective since epoxy groups react to form polymers with the amine groups on the aminopolysiloxane to render the coating even more impervious.

The coating agents were employed in situ thus avoiding a separate coating step. These coating agents could be used in conventional propellants and gas generants containing mildly acidic oxidizers such as ammonium perchlorate and ammonium nitrate to improve aging. These coating agents may be expected to function as bonding agents since they are reactive with the solids and contain groups capable of reacting with the binder. Though the examples were carried out with trimethoxysilyl propylethylene diamine (ZC-6020 Dow Corning) any other compound of the formula $R\text{-}NHCH_2CH_2CH_2Si(OCH_3)_3$ would easily work well.

Although specific components, proportions and procedures have been stated in the above description of the preferred embodiments of the novel void free propellant composition and its process, other suitable materials and procedures such as those described above may be employed to synergize, enhance or otherwise modify the novel method Other modifications and ramifications of the present invention would appear to those skilled in the art upon a reading of this disclosure. These are intended to be included within the scope of this invention.

What is claimed is:

1. A process of making void free propellants comprising mixing glycidyl azide polymer, a deflagrating agent selected from the group consisting of guanylaminotetrazole, the ammonium salt of 5-nitraminotetrazole, dihydrazinium 3,6-bistetrazolyl-1,2-dihydrotetrazine, and guanidine bitetrazole, a compound of the formula $R\text{-}NHCH_2CH_2CH_2Si(OCH_3)_3$ and dimer acid diepoxide, to form a slurry;

stirring said slurry;

heating the slurry in a vacuum at 120°-140° F.;

adding isocyanate curative to the slurry to form a mixture; and curing said mixture.

2. Process of claim 1 wherein in the formula R-$NHCH_2CH_2CH_2Si(OCH_3)_3$ R is $H_2NCH_2CH_2$.

3. Process of claim 1 wherein the deflagrating agent is Guanylaminotetrazole.

4. Process of claim 1 wherein the deflagrating agent is ammonium salt of 5-nitraminotetrazole.

5. Process of claim 1 wherein the deflagrating agent is dihydrazinium-3,6-bistetrazolyl-l,2-dihydrotetrazine.

6. Process of claim 1 wherein the deflagrating agent is guanidine bitetrazole.

7. A void free solid propellant composition comprising glycidyl azide polymer, a deflagrating agent selected from the group consisting of guanylaminotetrazole, the ammonium salt of 5-nitraminotetrazole, dihydrazinium, 3,6-bistetrazolyl-1,2-dihydrotetrazine and guanidine bitetrazole, dimer acid diepoxide, an amine silane and an isocyanate curative.

8. Composition of claim 7 wherein the deflagrating agent is guanylaminotetrazole.

9. Composition of claim 7 wherein the deflagrating agent is the ammonium salt of 5-nitraminotetrazole.

10. Composition of claim 7 wherein the deflagrating agent is dihydrazinium 3,6-bistetrazolyl-l,2-dihydrotetrazine.

11. Composition of claim 7 wherein the deflagrating agent is guanidine bitetrazole.

12. The composition of claim 7 wherein said amine silane is $H_2NCH_2CH_2NHCH_2CH_2CH_2Si(OCH_3)_3$.

* * * * *